US006584631B1

(12) United States Patent
Jones, Sr.

(10) Patent No.: US 6,584,631 B1
(45) Date of Patent: Jul. 1, 2003

(54) SUPPORT PILLOW FOR MAINTAINING A HAIRSTYLE

(76) Inventor: Ronald D. Jones, Sr., 7317 E. 50th Pl. 33-1, Tulsa, OK (US) 74145

( * ) Notice: Subject to any disclaimer, the term of this patent is extended or adjusted under 35 U.S.C. 154(b) by 0 days.

(21) Appl. No.: 10/246,260

(22) Filed: Sep. 18, 2002

(51) Int. Cl.[7] ..... A47G 9/10
(52) U.S. Cl. ..... 5/636; 5/637; 5/643
(58) Field of Search ..... 5/636, 637, 652, 5/655.9, 639, 640, 643

(56) References Cited

U.S. PATENT DOCUMENTS

| | | | | | |
|---|---|---|---|---|---|
| 3,035,279 | A | * | 5/1962 | Stead | 5/632 |
| 3,148,386 | A | * | 9/1964 | Shebib | 5/632 |
| 3,602,928 | A | * | 9/1971 | Helzer | 5/644 |
| 3,949,437 | A | * | 4/1976 | Gritsch | 5/643 |
| 4,393,530 | A | * | 7/1983 | Stark | 5/640 |
| 4,550,459 | A | * | 11/1985 | Endel et al. | 5/640 |
| 5,343,582 | A | * | 9/1994 | Baylor | 5/639 |
| 5,572,757 | A | | 11/1996 | O'Sulllivan | |
| 5,575,028 | A | | 11/1996 | Brau et al. | |
| 5,863,095 | A | | 1/1999 | Rivard et al. | |
| 6,042,604 | A | | 3/2000 | Gennetti | |
| 6,135,560 | A | * | 10/2000 | Fagg | 5/636 |
| 6,230,347 | B1 | | 5/2001 | Alexander | |
| D449,482 | S | | 10/2001 | Berke et al. | |
| D449,483 | S | | 10/2001 | Berke et al. | |
| 6,336,236 | B1 | | 1/2002 | Dalton | |
| 6,363,557 | B2 | | 4/2002 | Chou | |

* cited by examiner

*Primary Examiner*—Heather Shackelford
*Assistant Examiner*—Frederick Lagman
(74) *Attorney, Agent, or Firm*—John D. Gugliotta; P. Jeff Martin

(57) ABSTRACT

A support pillow for maintaining a hairstyle is provided which allows one to maintain his or her hairstyle while sleeping. The support pillow has a flexible cushion supported by a plastic shell stabilizer. The cushion includes a base portion which supports a toroidal portion. An oval-shaped cavity separates upper and lower circumferential edges of the toroidal portion. The oval-shaped cavity houses a domed protuberant. The toroidal portion bifurcates into a pair of downwardly directed offshoot members which merge into a bulbous portion, thereby forming a generally triangular-shaped opening which provides entrance to a hollow cavity. The hollow cavity accommodates a removable, fluffed pillow. An overlay conforms to an outer surface of the cushion and shell stabilizer.

15 Claims, 8 Drawing Sheets

SUPPORT PILLOW FOR MAINTAINING A HAIRSTYLE

RELATED APPLICATIONS

The present invention was first described in Disclosure Document Registration 510,720 filed on Apr. 30, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to a pillow and, more particularly, to a support pillow for maintaining a hairstyle.

2. Description of the Related Art

Well groomed, fashionable, luxuriant hair is beautiful and can signify youth, health, and vitality. Thus, many individuals expend a great deal of time and money in order to have beautiful hair as well as to stay on top of new fashion trends. Trendy and fashionable hairstyles remain at the pinnacle of being in vogue, and as a result, many flock to hair salons to acquire that particularly desired cut in order to keep up with ever-evolving hairstyles. However, most lose their newly acquired hairstyle after only a single night's rest on a traditional pillow.

Accordingly, a need has arisen for a means by which a person can sleep with a comfort pillow which allows one to preserve his/her hairstyle. The development of the support pillow for maintaining a hairstyle fulfills this need.

A search of the prior art did not disclose any patents that read directly on the claims of the instant invention; however, the following references were considered related.

U.S. Pat. No. 5,863,095 issued in the name of Rivard et al. describes a lobed lumbar pillow disclosing a tri-lobed, resilient design.

U.S. Pat. No. 5,572,757 issued in the name of O'Sullivan describes a pillow of a split-spherical design in which each half is removable and made of a resilient material.

U.S. Pat. No. 5,575,028 issued in the name of Brau et al. describes a utility patent for a novelty pillow design incorporating storage function.

U.S. Pat. No. 6,042,604 issued in the name of Gennetti describes an extremity support that has a flapped pocket for insertion of heating or cooling elements.

U.S. Pat. No. D449,482 and D449,483, both issued in the name of Berke et al. each describe an ornamental design for a pillow that shows an arm recess formed on the bottom side.

U.S. Pat. No. 6,336,236 issued in the name of Dalton describes a pillow that has apertures designed to accommodate the arms of the user.

U.S. Pat. No. 6,363,557 issued in the name of Chou describes a modular pillow that is adjustable.

U.S. Pat. No. 6,230,347 issued in the name of Alexander describes an orthopedic comfort pillow that prevents shifting of stuffing contents during use.

Consequently, a need has been felt for a means by which a person can sleep with a comfort pillow which allows one to preserve his/her hairstyle in a manner which is quick, easy, and efficient.

SUMMARY OF THE INVENTION

Therefore, it is an object of the present invention to provide a support pillow designed and configured so as to allow one to preserve his/her newly acquired hairstyle.

It is another object of the present invention to provide a toroidal portion which provides support to one's cheek and jaw areas.

It is another object of the present invention to provide a hollow cavity designed and configured so as to accommodate a removable, fluffed pillow for comfortably accommodating one's shoulder.

It is another object of the present invention to provide a shell stabilizer in order to provide some measure of pillow rigidity.

It is another object of the present invention to provide a pair of bulbous portions which operate cooperatively with a base portion to facilitate favorable gradient shoulder support, wherein bulbous portions extend beyond a length of a pair of feet of shell stabilizer.

It is another object of the present invention to provide an overlay in order to impart some degree of comfort against body skin as well as to provide a sleek, uniform overall appearance to present invention.

It is still another object of the present invention to provide a closable opening In order to allow for removal of the overlay.

Briefly described according to one embodiment of the present invention, a support pillow for maintaining a hairstyle is provided which allows one to maintain his or her newly acquired hairstyle while sleeping with a support pillow. The support pillow is defined by a flexible, elastomeric cushion supported by a semi-rigid plastic shell stabilizer. The shell stabilizer serves to provide some measure of rigidity to the present invention.

The cushion is further defines a base portion which supports a generally toroidal portion at an upper end thereof. The toroidal portion has an upper circumferential edge for cushionably and resiliently supporting one's cheek. The upper circumferential edge provides a cheek contacting surface. The toroidal portion has a lower circumferential edge which provides cushionable and resilient support to one's jaw. The lower circumferential edge provides a jaw contacting surface. A relatively shallow, oval-shaped cavity separates the upper and lower circumferential edges. The oval-shaped cavity is filled with a combination of cellular elastomeric material and animal feathers so as to provide a firm, bulging, domed protuberant. The lower circumferential edge of the toroidal portion bifurcates into a pair of downwardly directed offshoot members.

The offshoot members define lower extremities being convoluted and which integrally and smoothly merge into a first bulbous portion, thereby forming a generally triangular-shaped opening providing entrance to a hollow cavity designed and configured so as to accommodate a removable, fluffed pillow which serves to comfortably accommodate one's shoulder.

A lower end of the base portion has inwardly curved corners which merge smoothly into a second bulbous portion.

The pair of bulbous portions operate cooperatively With a base portion to facilitate favorable gradient shoulder support, wherein bulbous portions extend beyond a length of a pair of feet of shell stabilizer.

An overlay is provided in order to impart some degree of comfort against body skin. The overlay is designed and configured so as to conform to an outer surface of the cushion.

A closable opening is provided along a rear side of overlay. The closable opening allows the overlay to be removed.

The use of the present invention allows one to maintain his/her particular hairstyle while sleeping in a manner which is quick, easy, and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
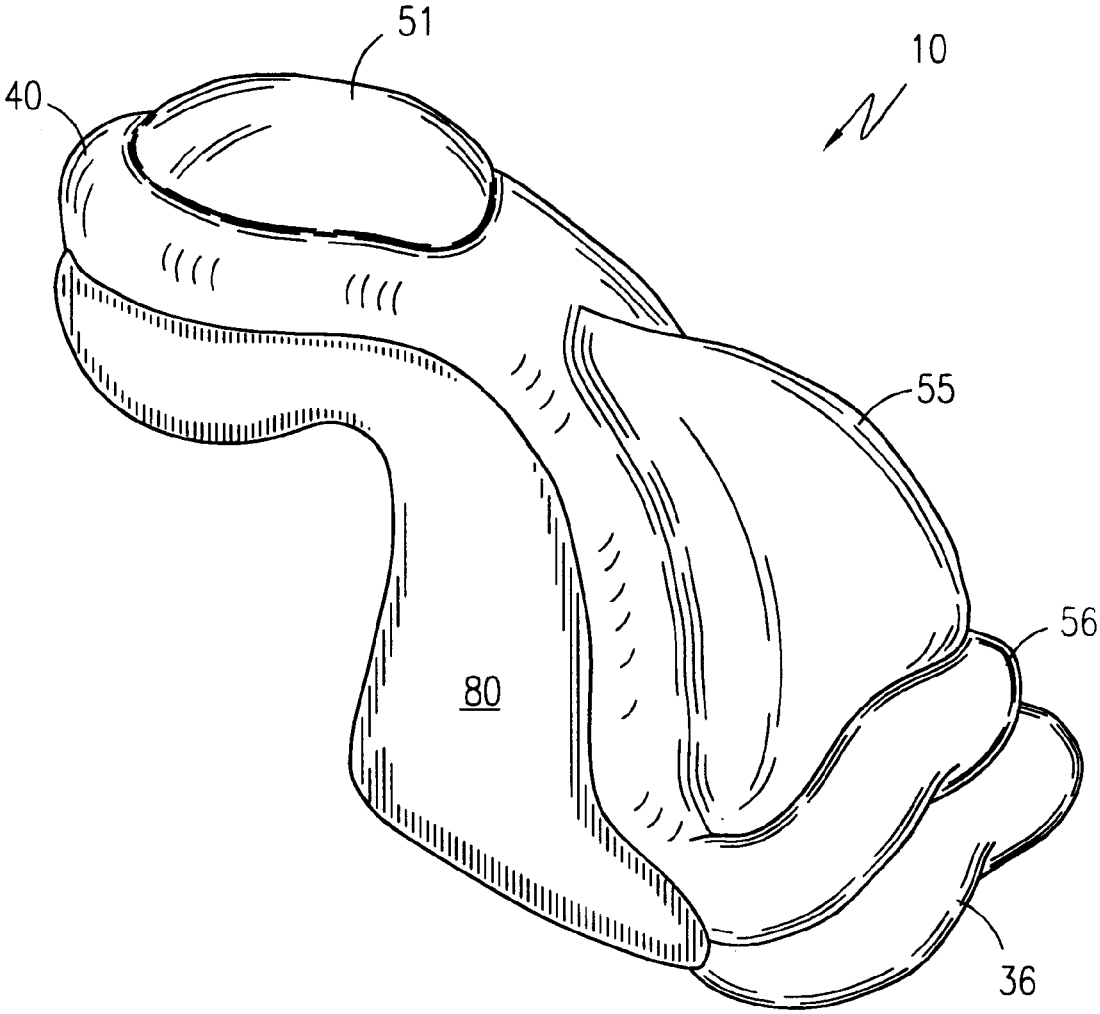
FIG. 1 is a perspective view of a support pillow for maintaining a hairstyle, according to the preferred embodiment of the present invention.
Figure 2:
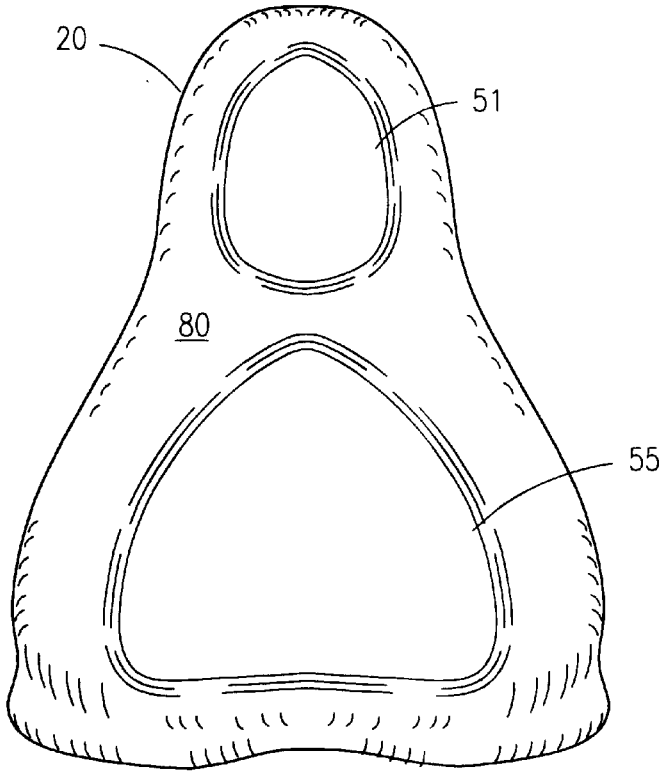
FIG. 2 is a top plan view of the support pillow for maintaining a hairstyle according to the preferred embodiment of the present invention.
Figure 3:
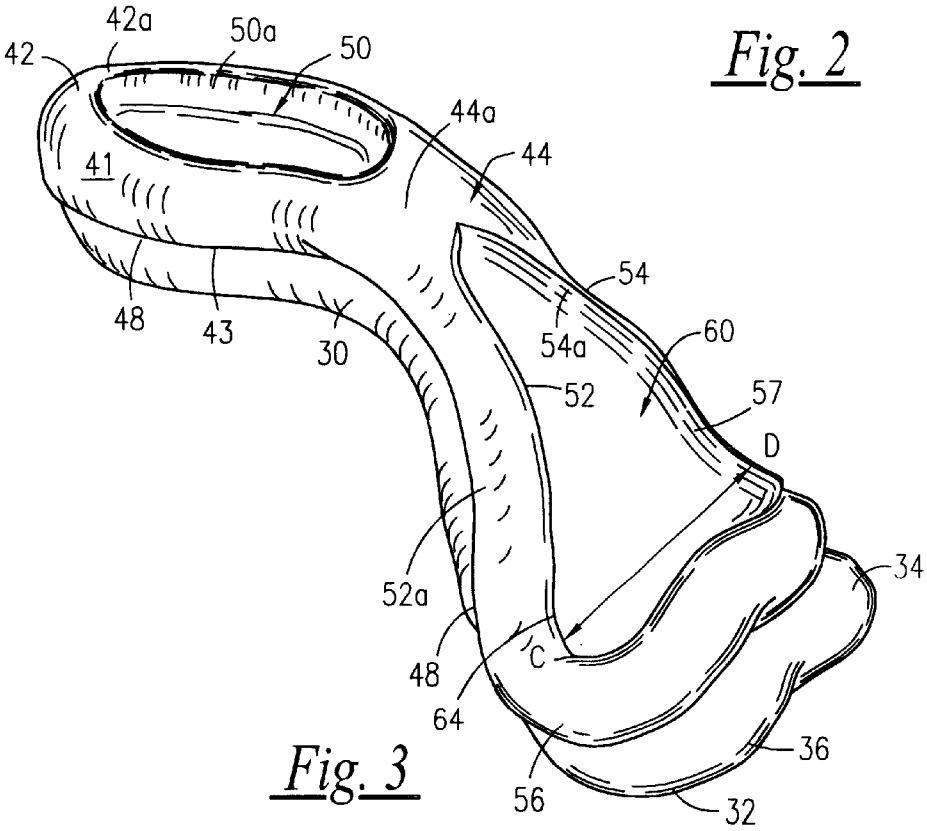
FIG. 3 is a perspective view of the cushion thereof.
Figure 4:
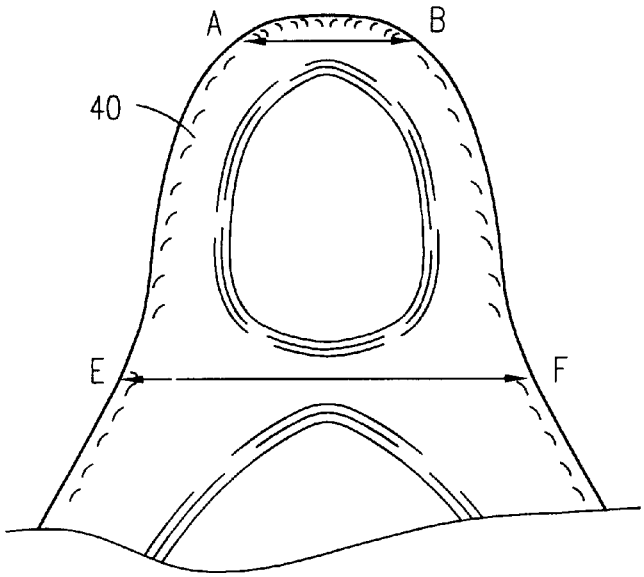
FIG. 4 is a partial top plan view of the toroidal portion of the cushion according to the preferred embodiment of the present invention.
Figure 5:
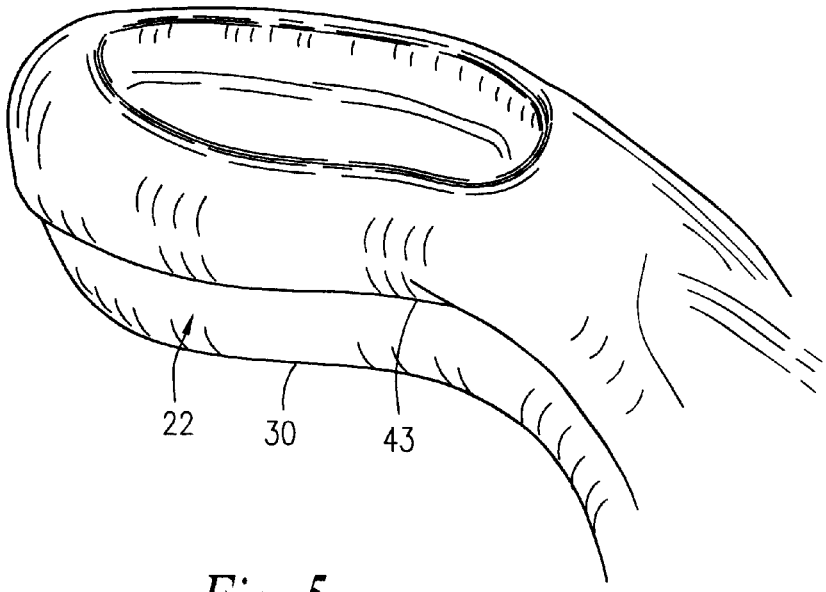
FIG. 5 is a side elevational view of the toroidal portion of the cushion according to the preferred embodiment of the present invention.

Referring now to FIGS. 1–8, a support pillow for maintaining a hairstyle 10 is shown, according to the present invention, comprised of a flexible, elastomeric cushion 20. The cushion 20 is fabricated from a cellular elastomeric material 22 including but not limited to rubber, polysulfide polymers, chloroprene polymers, vinyl chloride copolymer, vinyl acetate copolymer, and polysiloxanes. It is envisioned that the cushion 20 may also be formed from a combination of cellular elastomeric material and animal feathers, such as goose down, or natural plant fibers.

It is further envisioned that the cushion 20 has an overall length measuring approximately 19 inches.

Referring more specifically to FIGS. 3–5, and 9, the cushion 20 is further defined as having a base portion 30 which supports a generally toroidal portion 40 at an upper end thereof. The toroidal portion 40 defines a peripheral, circumferential sidewall 41 which integrally merges with a concave-shaped bottom wall 43. Partition 48 separates bottom wall 43 of toroidal portion 40 and base portion 30. The toroidal portion 40 has an upper circumferential edge 42 for cushionably and resiliently supporting one's cheek 82. The upper circumferential edge 42 provides a cheek contacting surface 42*a* having a width, as depicted by line A–B, measuring approximately 2–3 inches. A lower circumferential edge 44 provides cushionable and resilient support to one's jaw 84. The lower circumferential edge 44 provides a jaw and neck contacting surface 44*a* having a width, as depicted by line E—F, measuring approximately 4–6 inches. A relatively shallow, oval-shaped cavity 50 separates the upper and lower circumferential edges 42, 44. The oval-shaped cavity 50 has a diameter measuring approximately 3½ inches and a depth measuring approximately 2½ inches to 3 inches. The oval-shaped cavity 50 is filled with a combination of cellular elastomeric material and animal feathers so as to provide a firm, bulging, domed protuberant 51 suitably adhered to sidewalls 50*a* of oval-shaped cavity 50.

The lower circumferential edge 44 of the toroidal portion 40 bifurcates into a pair of downwardly directed offshoot members 52, 54 wherein each offshoot member 52, 54 has lateral sidewalls 52*a*, 54*a* respectively, which converge inwardly with increased distance from each respective offshoot member 52, 54 until joining partition 48.

The offshoot members 52, 54 define lower extremities being convoluted and which integrally and smoothly merge into a first bulbous portion 56, thereby forming a generally triangular-shaped opening 60 providing entrance to a hollow cavity 57 designed and configured so as to accommodate a removable, fluffed pillow 55. As measured between a widest distance of the triangular-shaped opening 60, as depicted by line C—D, a distance of approximately 12 inches is envisioned. The removable, fluffed pillow 55 serves to comfortably accommodate one's shoulder 88.

A lower end of the base portion 30 has inwardly curved corners 32, 34 which merge smoothly into a second bulbous portion 36. Lying below the first bulbous portion 56, the second bulbous portion 36 lies slightly forward relative thereto. Each of the first and second bulbous portions 56, 36 has a height of approximately 3 inches. The first and second bulbous portions 56, 36 operate cooperatively with the base portion 30 to facilitate favorable gradient shoulder support.

Figure 6:
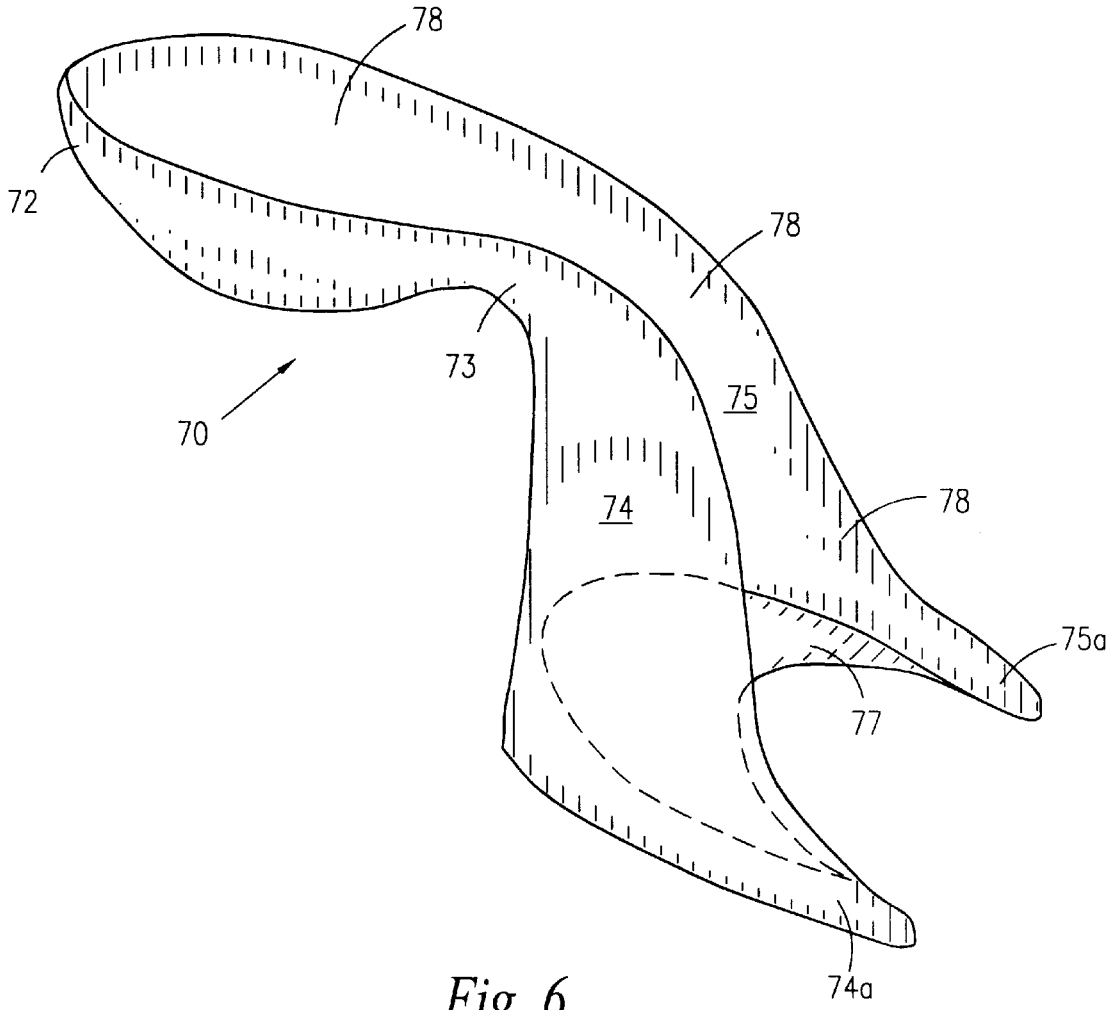
FIG. 6 is a side elevational view of the shell stabilizer according to the preferred embodiment of the present invention.
Figure 7:
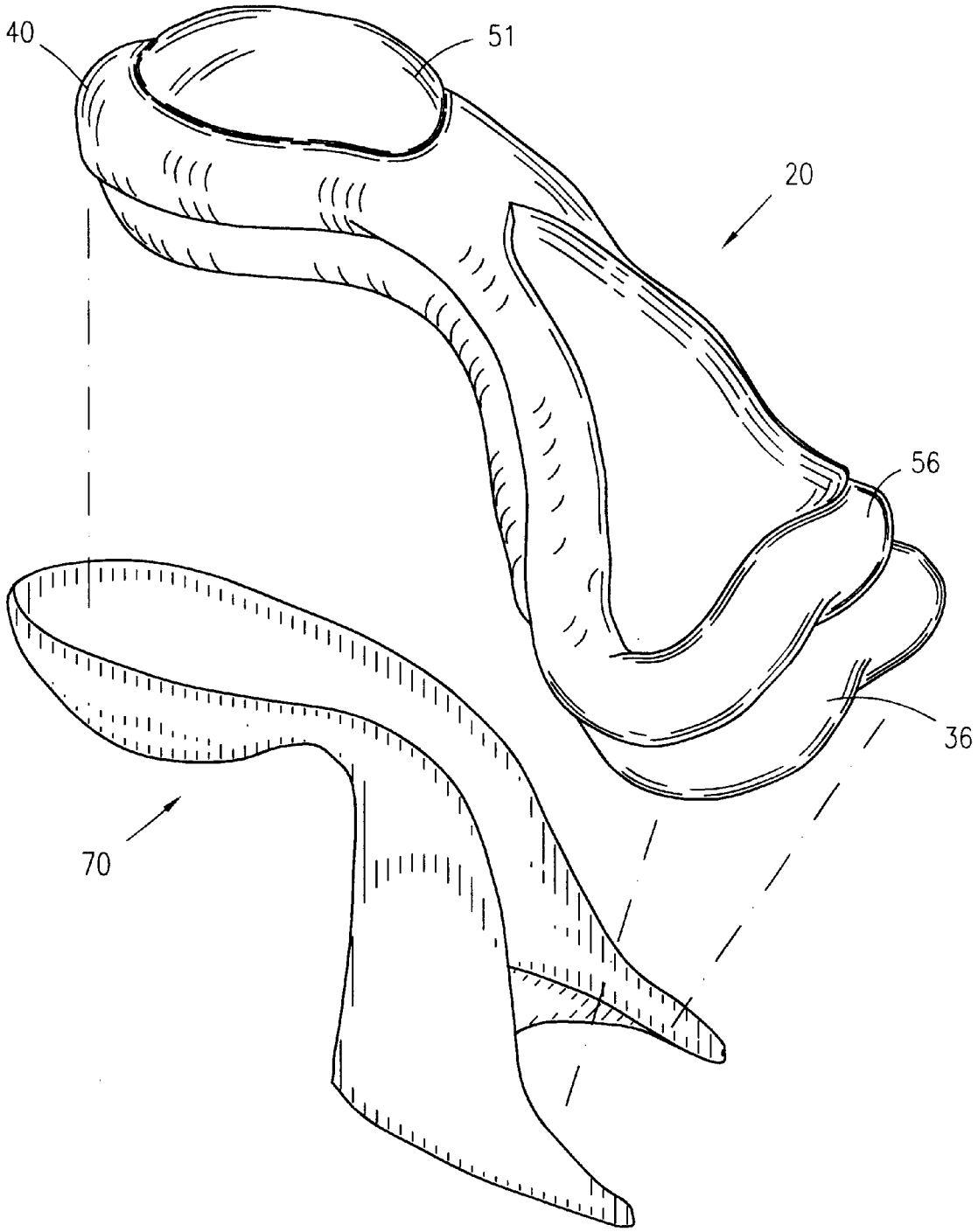
FIG. 7 is an exploded perspective view of the present invention according to the preferred embodiment.
Figure 8:
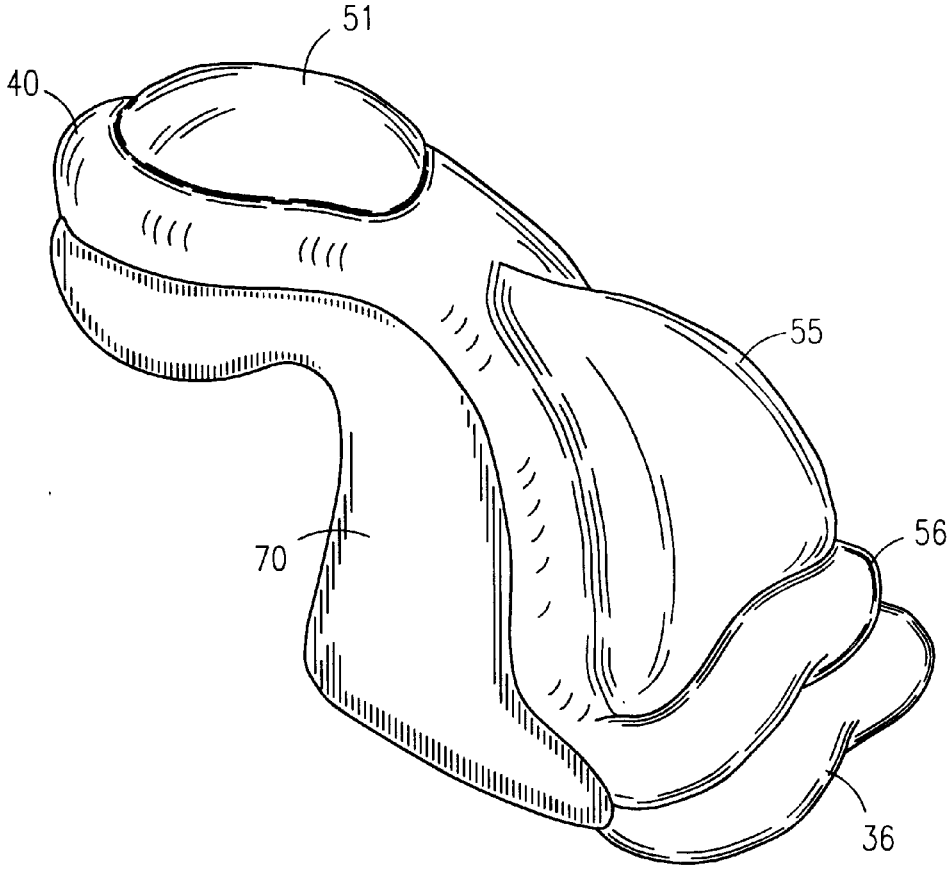
FIG. 8 is a perspective view of the present invention shown fully assembled for use.
Figure 9:
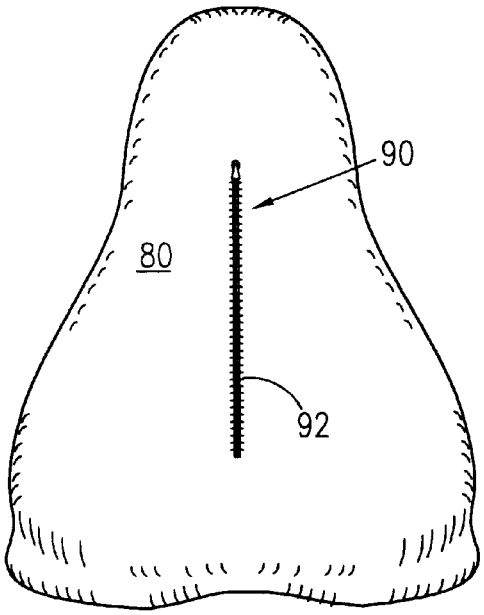
FIG. 9 is a bottom plan view of the view of the support pillow for maintaining a hairstyle according to the preferred embodiment of the present invention.
Figure 10:
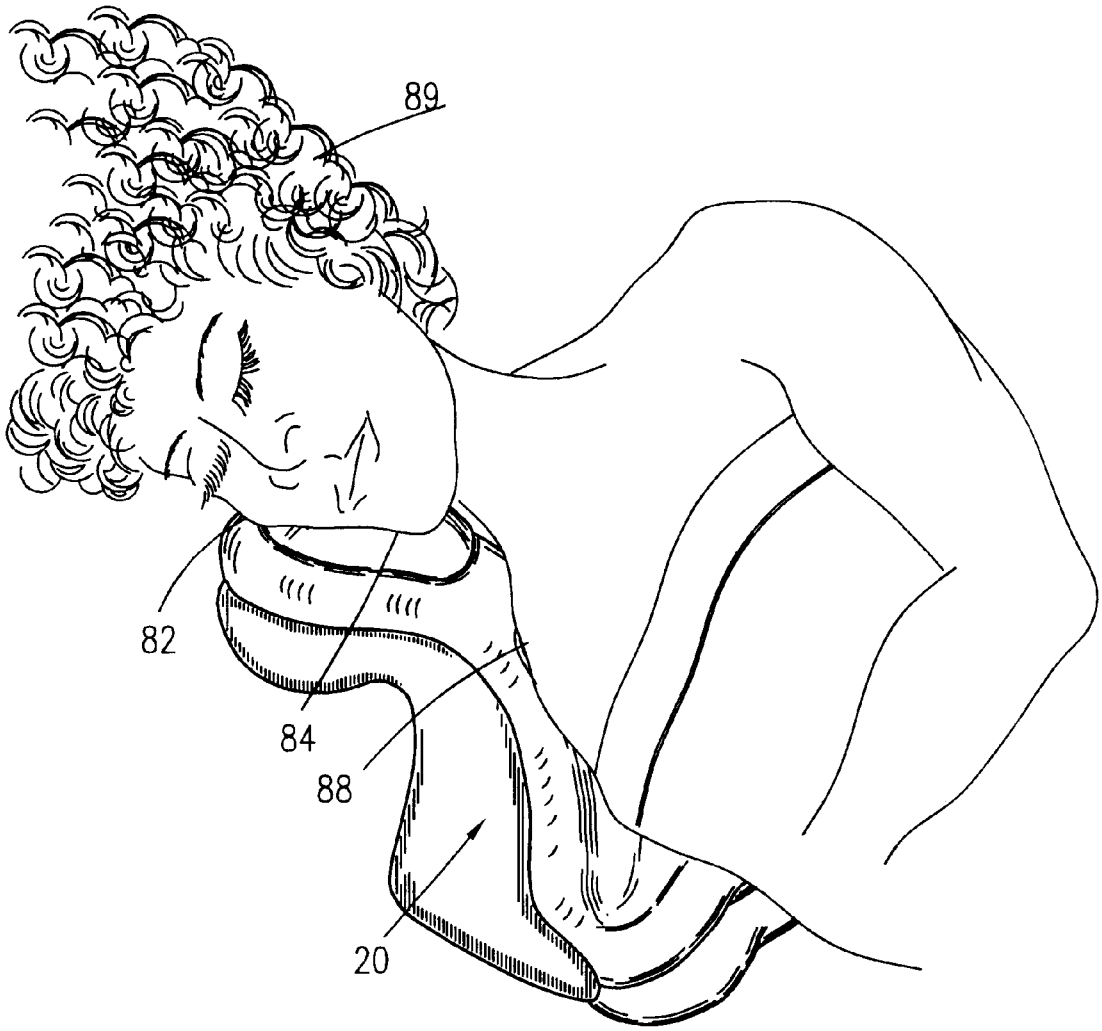
FIG. 10 is a perspective view of the present invention shown in-use.

Referring now to FIGS. 6 and 7, in order to provide some measure of rigidity, and to allow the present invention to rest in a generally upright manner, a shell stabilizer 70, fabricated of a semi-rigid plastic polymer, is provided. The shell stabilizer 70 is envisioned as being fabricated of a ½ inch thick plastic polymer including but not limited to polyurethane and polypropylene.

The shell stabilizer 70 defines a convex-shaped, generally circular, upper support 72 having a diameter of approximately 2½ inches and a depth of approximately 1 inch. Sidewalls 74, 75 extend forwardly and downwardly in a curved manner from a neck portion 73 of upper support 72. The sidewalls 74, 75 are integrally merged and wherein each sidewall 74, 75 terminates into a respective foot 74*a*, 75*a*. Each foot 74*a*, 75*a* lies in a spaced manner separated by a distance of approximately 12 inches.

Integrally molded perpendicularly between each foot 74*a*, 75*a* lies a planar, semi-circular base portion 77. It is envisioned that the distance between the neck portion 73 and the semi-circular base portion 77 measures approximately 4 inches.

The shell stabilizer 70 is further defined as having.an open, frictional gripping cavity 78 which extends from the upper support 72 thereof to foot 74*a*, 75*a* thereof. The frictional gripping cavity 78 is designed and configured so as to facilitate impingable reception and partial conformation of the cushion 20 therein, in a manner whereby base portion 30 of cushion 20 is securely held within frictional gripping cavity 78 via frictional impingement.

It is further envisioned that each sidewall 74, 75 has a height of approximately 4 inches, as-measured between each foot 74*a*, 75*a* thereof and the neck portion 73.

It is envisioned that the shell stabilizer 70 has an overall length measuring approximately 17½ inches.

Referring now to FIGS. 1, 2, 8, and 9, an overlay 80 is provided in order to impart some degree of comfort against body skin. The overlay 80 is fabricated of natural or synthetic fibers being suitable not only for supplying softness and comfort, but also being hypo-allergenic. Such fibers include but are not limited to cotton, cotton blends, satin, and nylon. The overlay 80 is designed and configured so as to fittingly conform to an entire outer surface of the cushion 20 and shell stabilizer 70 as is more clearly shown in FIG. 1 which illustrates the present invention as fully assembled for use.

In order to allow for removal of the overlay 80, a closable opening 90 is provided along a rear side of overlay 80. The closable opening 90, shown herein as a zippered opening 92, allows for the overlay 80 to be removed, thereby being washable and dryable, and hence facilitates increased hygiene. The zippered opening 92 further allows access to the cushion 20 in the event user desires to augment or modify cushion stuffing materials.

The closable opening 90 as described hereinabove, is meant merely as a suggestion, as it is recognized that other means for effectuating closure of an opening would be equally functional, and as such, is not intended to be a limiting factor.

Figure 11:
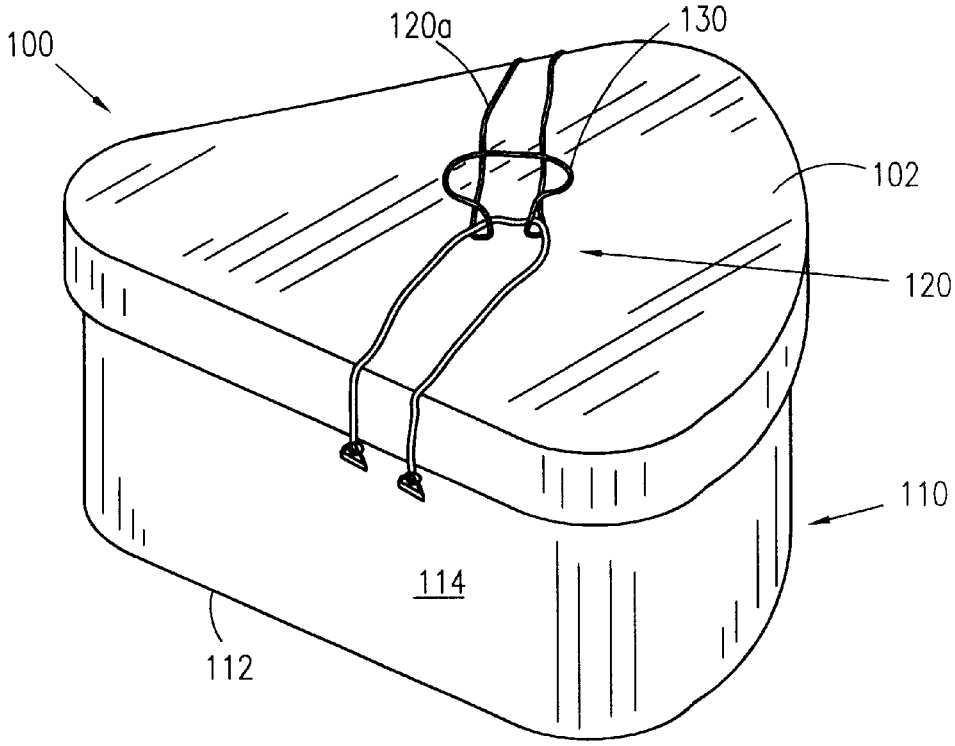
FIG. 11 is a perspective view of a carrying case.
Figure 12:
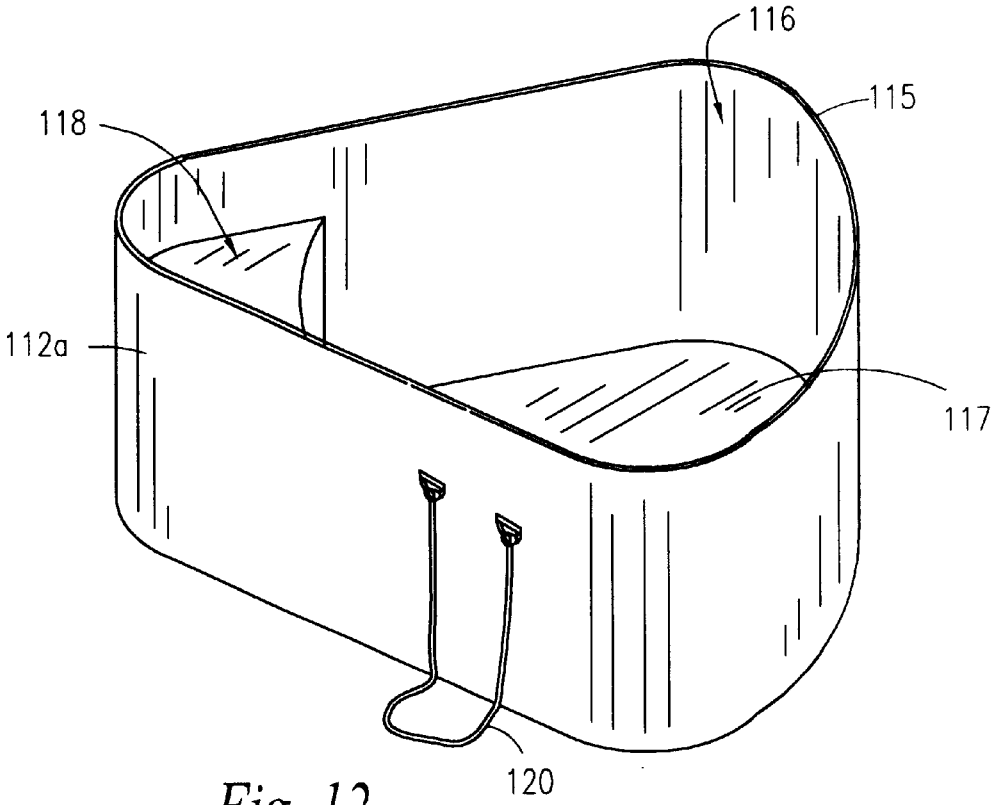
FIG. 12 is a perspective view of the carrying case illustrating an interior thereof.

Finally, referring to FIGS. 11 and 12, a portable, lightweight, carrying case 100 is provided for storing the support pillow 10. The carrying case 100 has a generally boule-shaped configuration and includes a cover 102 to be slidably received in a snug manner over a bottom 110 of the carrying case 100. The bottom 110 defines a base 112 from which an integral sidewall 114 extends vertically along an entire peripherally thereof. A top portion 115 of the bottom 110 defines an opening 116 leading into a support pillow storage cavity 117. A triangular-shaped toroidal support platform 118 extends upward from the base 112 at a forward end 112*a* thereof to a height reaching approximately midway a height of integral sidewall 114. The bottom 110 of the carrying case 100 is designed and configured so as to house the support pillow 10 in a snug manner when not in use. The triangular-shaped toroidal support platform 118 serves to provide support to the toroidal portion 40 of the support pillow 10.

A pair of pliable straps 120 are affixed along opposing sidewalls 114 so as to facilitate easy handling and transport of the carrying case 100. One strap 120*a* includes an oval-shaped, hollow leather handle 130 affixed to an end thereof for being grasped by a hand of user.

It is envisioned that the carrying case 100 is covered with a durable fabric being available in a variety of aesthetically pleasing colors, textures, and designs.

The use of the present invention allows one to maintain his/her particular hairstyle 89 while sleeping in a manner which is quick, easy, and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A support pillow comprising:

a flexible cushion, said flexible cushion is fabricated from a cellular elastomeric material;

a base portion, said base portion has an upper end opposite a lower end, said upper end of said base portion supports a toroidal portion, wherein said toroidal portion defines a peripheral, circumferential sidewall which integrally merges with a concave-shaped bottom wall;

a partition, said partition separates said bottom wall of said toroidal portion and said base portion;

a pair of downwardly directed offshoot members, wherein each of said pair of offshoot members has lateral sidewalls which converge inwardly with increased distance from each of said pair of offshoot members until joining said partition;

a first bulbous portion;

a second bulbous portion;

a shell stabilizer, said shell stabilizer is fabricated of a semi-rigid plastic polymer;

an overlay, said overlay is fabricated of natural or synthetic fibers being suitable not only for supplying softness and comfort, but also being hypo-allergenic; and a closable opening, said closable opening is provided along a rear side of said overlay.

2. The support pillow of claim 1, wherein said lower end of said base portion defines inwardly curved corners which merge smoothly into said second bulbous portion, said second bulbous portion lies below and slightly forward of said first bulbous portion, wherein said first bulbous portion and said second bulbous portion each has a height of approximately 3 inches, and wherein said first bulbous portion and second bulbous portion operate cooperatively with said base portion to facilitate favorable gradient shoulder support.

3. The support pillow of claim 1, wherein said toroidal portion has an upper circumferential edge for cushionably and resiliently supporting a cheek and a lower circumferential edge opposite to said upper circumferential edge for providing cushionable and resilient support to a jaw, said upper circumferential edge has a cheek contacting surface having a width measuring approximately 2–3 inches, said lower circumferential edge has a jaw and neck contacting surface having a width measuring approximately 4–6 inches, and wherein said upper circumferential edge and said lower circumferential edge are separated by an oval-shaped cavity, said oval-shaped cavity being relatively shallow.

4. The support pillow of claim 3, wherein said lower circumferential edge of said toroidal portion bifurcates into said pair of downwardly directed offshoot members, said pair of offshoot members define lower extremities being convoluted and which integrally and smoothly merge into said first bulbous portion, thereby forming a generally triangular-shaped opening which provides entrance to a hollow cavity, said triangular-shaped opening measures a distance of approximately 12 inches as measured between a widest distance of said triangular-shaped opening, and wherein said hollow cavity is designed and configured so as to accommodate a removable, fluffed pillow which serves to comfortably accommodate a shoulder.

5. The support pillow of claim 1, wherein said shell stabilizer defines a convex-shaped, generally circular, upper support, said upper support has a diameter of approximately 2½ inches and a depth of approximately 1 inch.

6. The support pillow of claim 5, wherein said shell stabilizer includes a pair of sidewalls which extend forwardly and downwardly in a curved manner from a neck portion of said upper support, said pair of sidewalls are integrally merged, and wherein each of said pair of sidewalls terminates into a respective foot, each said foot lies in a spaced manner separated by a distance of approximately 12 inches.

7. The support pillow of claim 6, wherein both of said foot has a planar, semi-circular base portion integrally molded perpendicularly therebetween, and wherein said neck portion is longitudinally distanced approximately 4 inches from said semi-circular base portion.

8. The support pillow of claim 6, wherein said shell stabilizer has an open, frictional gripping cavity extending from said upper support to both said foot, said open, frictional gripping cavity is designed and configured so as to facilitate impingable reception and partial conformation of said cushion in a manner whereby said base portion is securely held within said open, frictional gripping cavity via frictional impingement.

9. The support pillow of claim 1, wherein said overlay fittingly conforms to an entire outer surface of said flexible cushion and said shell stabilizer.

10. The support pillow of claim 1, wherein said closable opening is defined as a zippered opening which allows access to said flexible cushion and further allows for removal of said overlay in order to allow said overlay to be washed and dried, hence facilitating increased hygiene.

11. The support pillow of claim 1, wherein said flexible cushion is fabricated from a cellular elastomeric material which includes rubber, polysulfide polymers, chloroprene polymers, vinyl chloride copolymer, vinyl acetate copolymer, and polysiloxanes.

12. The support pillow of claim 1, wherein said flexible cushion is fabricated from a combination of cellular elastomeric material, goose down, and natural plant fibers.

13. The support pillow of claim 1, wherein said flexible cushion has an overall length measuring approximately 19 inches.

14. The support pillow of claim 1, wherein said shell stabilizer is fabricated of a ½ inch thick plastic polymer which includes polyurethane and polypropylene.

15. The support pillow of claim 1, wherein said shell stabilizer has an overall length measuring approximately 17½ inches.

* * * * *